US006325659B1

(12) United States Patent
Heinzen et al.

(10) Patent No.: US 6,325,659 B1
(45) Date of Patent: Dec. 4, 2001

(54) ELECTRICAL CONNECTOR FOR SOLDERLESS CONNECTION TO EDGE CARD CONNECTOR, AND DUAL CONNECTOR-PRINTED CIRCUIT BOARD ASSEMBLY

(75) Inventors: William J. Heinzen, Glenview; Kenneth G. Irish, Chicago, both of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/675,845

(22) Filed: Sep. 29, 2000

(51) Int. Cl.[7] ..... H01R 4/24
(52) U.S. Cl. ..... 439/404; 439/397; 439/405
(58) Field of Search ..... 439/404, 397, 439/401, 405, 682, 685

(56) References Cited

U.S. PATENT DOCUMENTS 4,405,193 * 9/1983 Weidler ..... 339/99 R
4,527,857 * 7/1985 Hughes et al. ..... 339/258 S
4,660,917 * 4/1987 DeRoss et al. ..... 339/97 R
4,671,601 * 6/1987 Lomecka ..... 439/404
5,915,990 * 6/1999 Beer et al. ..... 439/417
6,135,804 * 10/2000 Lux ..... 439/397

* cited by examiner

*Primary Examiner*—Tho D. Ta
*Assistant Examiner*—Ann McCamey
(74) *Attorney, Agent, or Firm*—Schwartz & Weinrieb

(57) ABSTRACT

An electrical connector comprises a plurality of electrical connector contacts which have insulation-displacement portions at first ends thereof and slidable pin-engaging portions at second opposite ends thereof whereby all wire-wrap electrical connections have been eliminated and all electrical connections between external wires and pin contacts of a second electrical connector are solderless. A gas tube over-protection printed circuit board can also be connected to the pin contacts of the second electrical connector in a solderless manner.

41 Claims, 8 Drawing Sheets

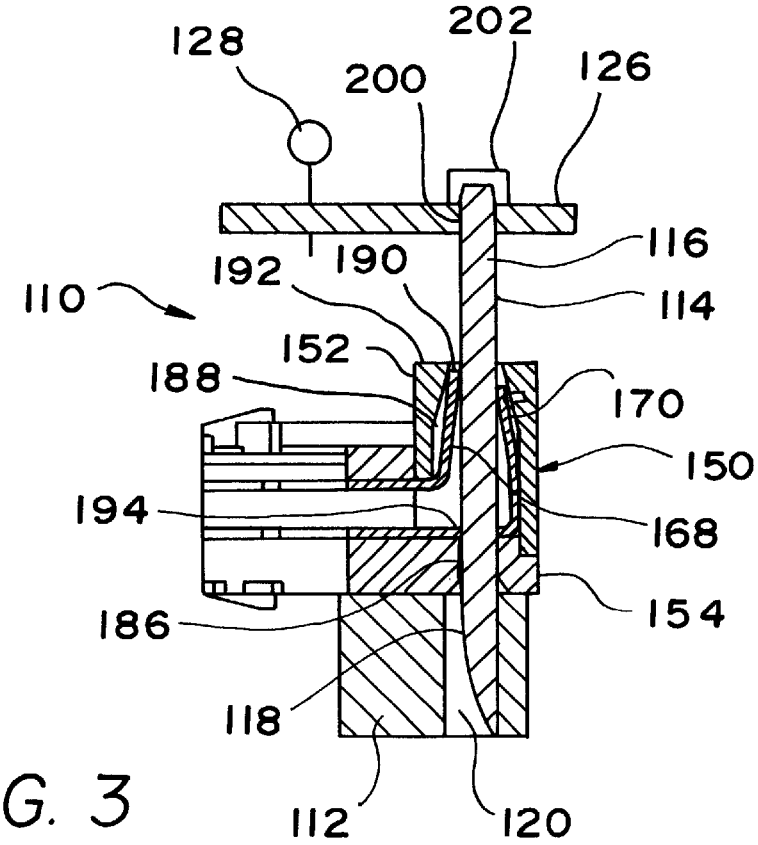
FIG. 3
FIG. 4
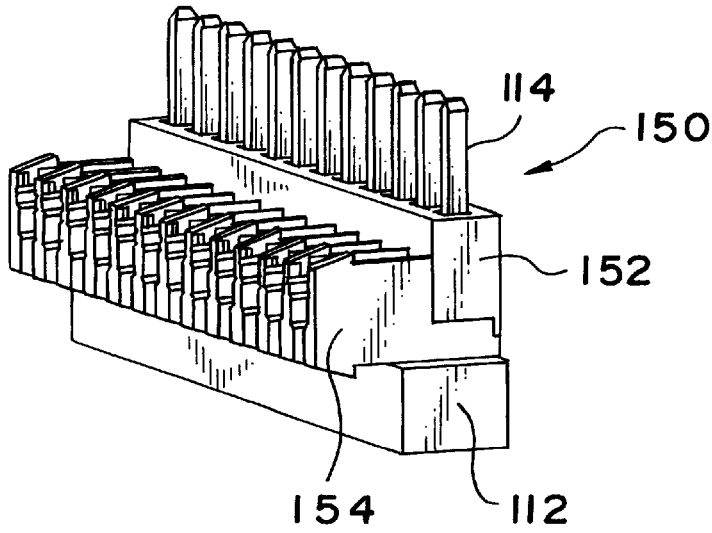

ELECTRICAL CONNECTOR FOR SOLDERLESS CONNECTION TO EDGE CARD CONNECTOR, AND DUAL CONNECTOR-PRINTED CIRCUIT BOARD ASSEMBLY

FIELD OF THE INVENTION

The present invention relates generally to electrical connectors, and more particularly to a new and improved insulation displacement-pin receiving type electrical connector which is able to electrically connect telephone lines to network equipment through means of a card edge type electrical connector, as well as to an assembly of the insulation displacement-pin receiving electrical connector, the card edge type electrical connector, and any one of several different types of over-voltage protection printed circuit boards, wherein all electrical connections are achieved in an entirely solderless manner.

BACKGROUND OF THE INVENTION

In the telecommunications industry, it is well-known to electrically interconnect telephone lines to network equipment through means of a card edge type electrical connector. More particularly, as best seen, for example, in FIGS. 1 and 2, a conventional or PRIOR ART electrical connection arrangement or assembly for achieving the aforenoted type connections within the telecommunications art is disclosed and is generally indicated by the reference character 10. The electrical connection arrangement comprises an elongated card edge type electrical connector 12 which is provided with a plurality of electrical contacts 14 which are disposed in an elongated or serial array along the length of the connector 12 and which respectively define a plurality of upstanding pin contact portions 16 protruding externally from the upper region of the connector 12, and a plurality of edge contact portions 18 which are disposed internally within the bottom region of the connector 12. The edge contact portions 18 are adapted to mate in a well-known manner with a printed circuit board, not shown, which is operatively connected to network equipment, also not shown, and which is adapted to be inserted into a recessed portion 20 of the connector 12 so as to electrically engage the edge contact portions 18. The upstanding pin contact portions 16 are adapted to be electrically engaged with telephone lines 22 through means of well-known wire-wrap type connections 24.

The electrical connection arrangement or assembly 10 is completed by the inclusion of an over-voltage protection printed circuit board 26 which is provided with a plurality of gas tube over-voltage protection devices 28 that are designed to fail upon sensing or being exposed to over-voltage conditions so as to protect the telecommunications circuits and network equipment. The over-voltage protection printed circuit board 26 is seen to be disposed atop the card edge connector 12 and comprises a plurality of apertures for permitting passage of the pin contacts 16 therethrough. In order to complete the entire assembly 10, it is to be appreciated that each one of the pin contacts 16 may be soldered to the over-voltage protection printed circuit board 26 as at 30, although the printed circuit board 26 could be connected to the pin contacts 16 by means of solderless connections. In addition, each one of the wire wrap connections 24 is soldered to its respective pin contact 16 as at 32, as best illustrated in and seen from FIG. 1. It can thus be appreciated that the fabrication of this assembly or arrangement can be quite time consuming and labor intensive, particularly in view of the different processes or procedures involved in conjunction with the fabrication or disposition of the wire-wrapped connections 24 upon the pin contacts 16.

A need therefore exists in the art for a new and improved electrical connector which can facilitate the simultaneous electrical connection of the telephone lines to the card edge connector, through the intermediary of the new and improved electrical connector, and wherein all electrical connections can be achieved in a solderless manner. In particular, a need exists in the art for a new and improved electrical connector wherein the telephone lines can in effect be electrically connected to the upstanding pins of the card edge connector without the need for wire-wrap connections to be defined between the telephone signal lines and the upstanding pins of the card edge connector. In this manner, all electrical connections can be readily performed in a time-efficient manner comprising minimum expenditures of manpower.

OBJECTS OF THE INVENTION

Accordingly, it is an object of the present invention to provide a new and improved electrical connector.

Another object of the present invention is to provide a new and improved electrical connector which is especially constructed for use in connecting telephone signal lines to a card edge connector.

An additional object of the present invention is to provide a new and improved electrical connector which is especially constructed for use in connecting telephone signal lines to a card edge connector, as well as to permit the attachment of an over-voltage protection printed circuit board to the pin contacts of the card edge connector such that the resulting assembly is especially useful within the telecommunications art.

A further object of the present invention is to provide a new and improved electrical connector which is especially constructed for use in connecting telephone signal lines to a card edge connector, as well as to permit the attachment of an over-voltage protection printed circuit board to the pin contacts of the card edge connector, such that the resulting assembly is especially useful within the telecommunications art, and wherein all electrical connections are able to be achieved in a relatively simple and solderless manner, especially those connections defined between the telephone signal lines and the upstanding pin contacts of the card edge connector.

SUMMARY OF THE INVENTION

The foregoing and other objectives are achieved in accordance with the teachings and principles of the present invention through the provision of a new and improved electrical connector which comprises a plurality of electrical contact members which are provided with insulation displacement contacts at first end portions thereof for connection to the telephone signal wires, and friction contacts at second end portions thereof for connection to the upstanding pin contacts of the card edge connector. The over-voltage protection printed circuit board is disposed atop the distal end portions of the upstanding pin contacts of the card edge connector by means of friction caps or sockets fixedly secured to the printed circuit board. In this manner, it is appreciated that all electrical connections are achieved in a solderless manner.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 3 is a cross-sectional end view similar to that of FIG. 1 showing, however, a new and improved electrical connector, for use in conjunction with a card edge connector, which is constructed in accordance with the principles and teachings of the present invention whereby all wire and pin contact connections are achieved in a solderless manner, and in addition, the assemblage with a gas tube over-voltage protection printed circuit board;

FIG. 4 is a perspective view, similar to that of FIG. 2 showing, however, the new and improved electrical connector constructed in accordance with the principles and teachings of the present invention and as illustrated in FIG. 3 wherein, however, the gas tube over-voltage protection printed circuit board has been omitted for clarity;

DETAILED DESCRIPTION OF THE PREFERRED EMBODIMENT

Figure 1:
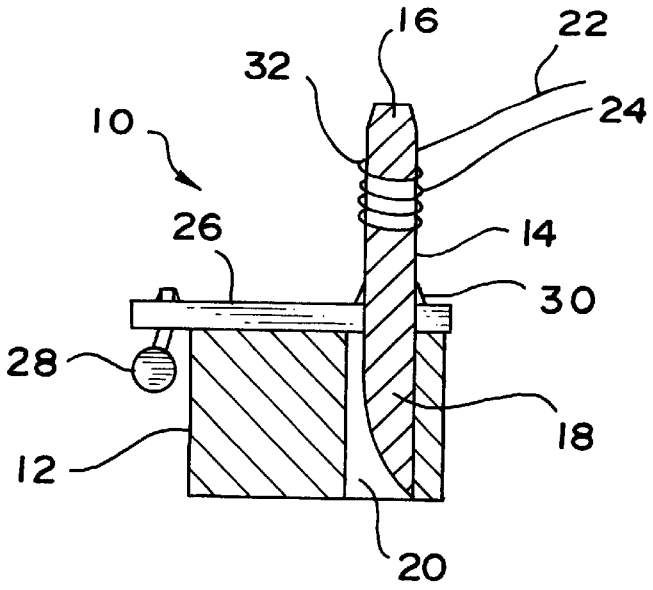
FIG. 1 (PRIOR ART)
FIG. 1 is a cross-sectional end view of a PRIOR ART card edge connector and gas tube over-voltage protection printed circuit board assembly conventionally used to electrically connect power lines to network equipment.
Figure 2:
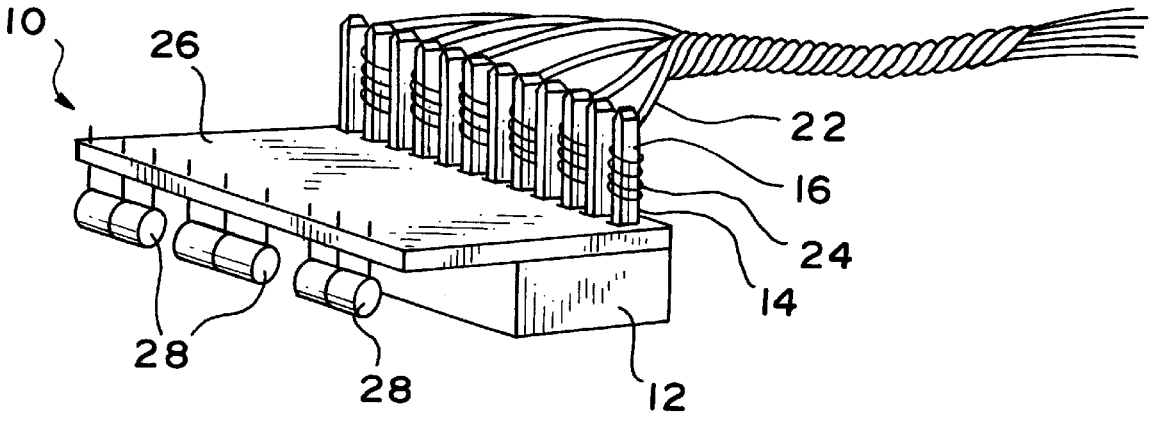
FIG. 2 (PRIOR ART)
FIG. 2 is a perspective view of the PRIOR ART card edge electrical connector and gas tube over-voltage protection printed circuit board assembly illustrated in FIG. 1.
Figure 5:
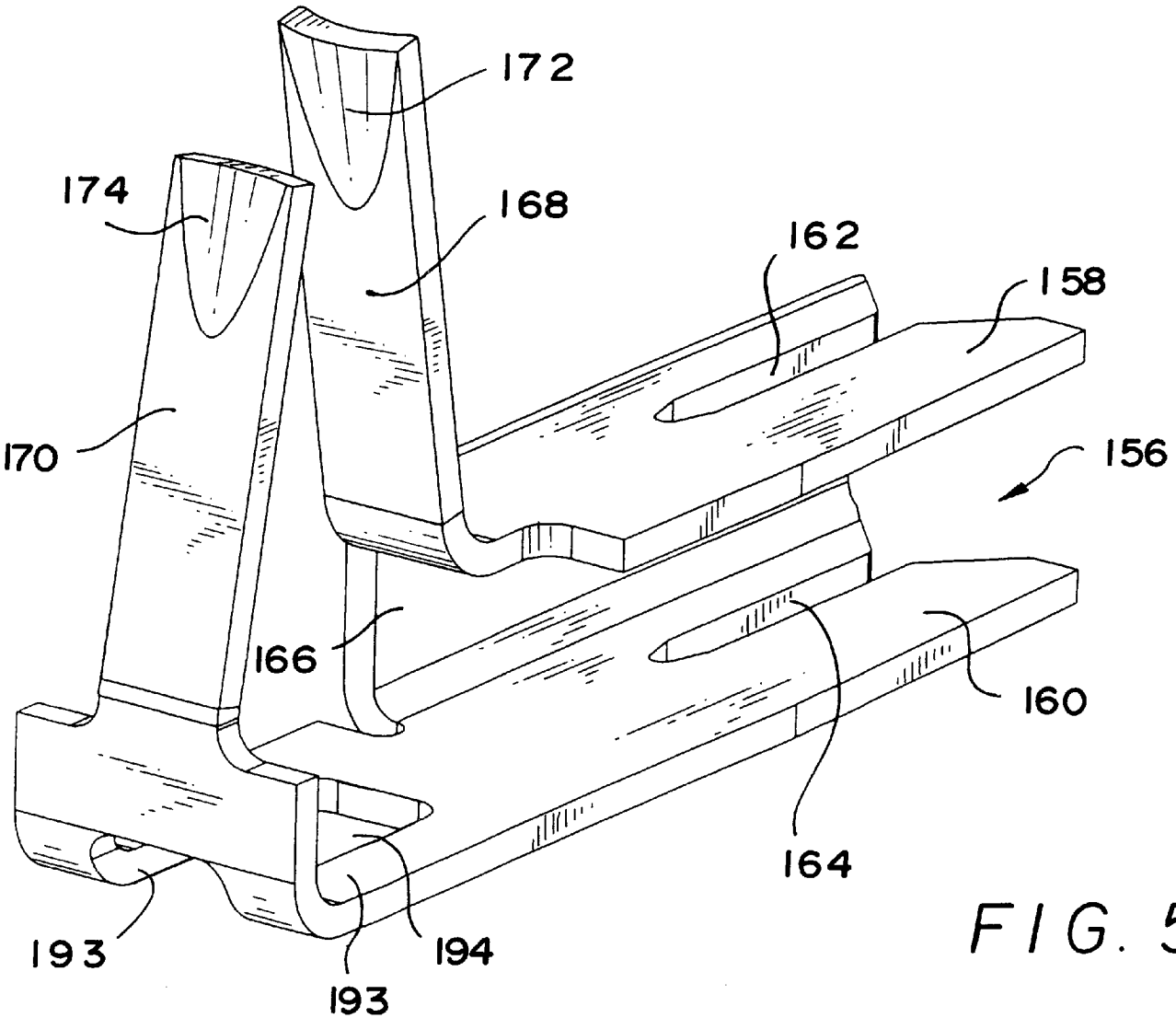
FIG. 5 is a perspective view of a first embodiment of one of the insulation displacement-pin engaging contacts utilized within the new and improved electrical connector constructed in accordance with the principles and teachings of the present invention.
Figure 6:
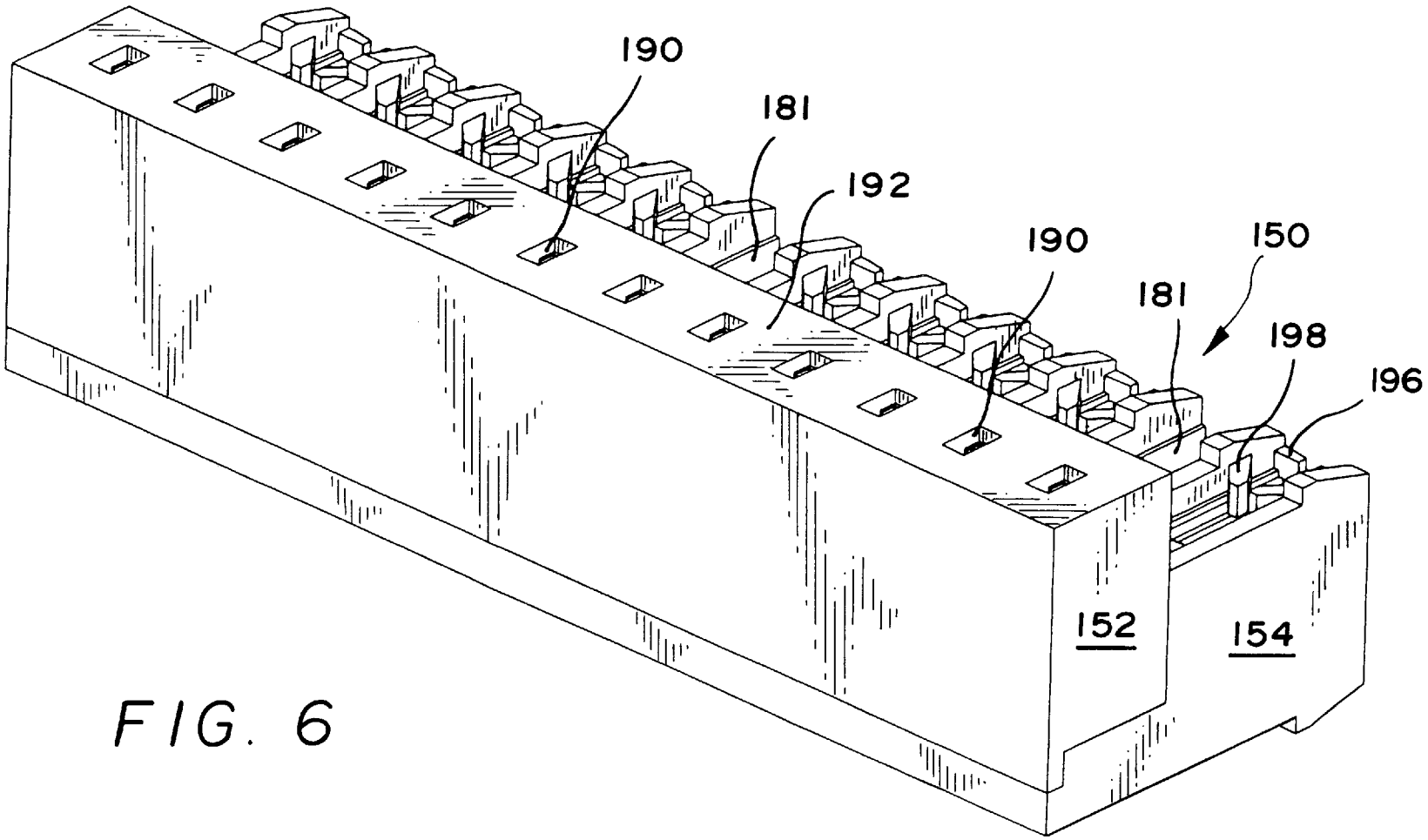
FIG. 6 is a perspective view of the new and improved assembled electrical connector constructed in accordance with the principles and teachings of the present invention and having the insulation displacement-pin engaging contacts disposed therein.

Referring now to the drawings, and more particularly to FIGS. 3 and 4 thereof, a new and improved electrical connection arrangement or assembly for use, for example, in connection with the protection of telecommunications equipment, is disclosed and is generally indicated by the reference character 110. It is to be noted that the assembly 110 disclosed within FIGS. 3 and 4 is somewhat similar to the assembly 10 disclosed within FIGS. 1 and 2, and accordingly, component parts of assembly 110 which correspond to similar parts of assembly 10 will be designated by similar reference characters except that the reference characters will be within the 100 series. More particularly, the new and improved electrical connection assembly 110 is seen to comprise a card edge connector 112 within which there is fixedly secured a plurality of electrical contacts 114 which define upstanding pin contacts 116 at upper end portions thereof, and card edge connector contacts 118 at the lower end portions thereof which are adapted to mate with a network equipment printed circuit board, not shown, which is adapted to be inserted into the space or recess 120 defined within the card edge connector 112. In conjunction with the card edge connector 112 and the electrical contacts 114 thereof, there has been developed in accordance with the principles and teachings of the present invention a new and improved electrical connector which is generally indicated by the reference character 150. As best seen from FIGS. 3, 4, 6, and 7, the new and improved electrical connector 150 is seen to comprise an upper plastic housing portion 152, a lower plastic housing portion 154, and a plurality of electrical insulation displacement-pin engaging contacts 156, as best seen in FIG. 5, disposed within the connector 150. As can best be appreciated from FIG. 7, the fabrication of the connector 150 from two separate plastic housing portions, that is, upper housing portion 152 and lower housing portion 154, permits the plurality of electrical insulation displacement-pin engaging contacts 156 to be easily inserted into the electrical connector 150. More particularly, the electrical contacts 156 are initially inserted and seated within the lower housing portion 154 whereupon the upper housing portion 152 is then seated upon the lower housing portion 154 and the plastic housing portions 152,154 are then ultrasonically welded together.

As may best be appreciated from FIG. 5, each one of the electrical insulation displacement-pin engaging contacts 156 is seen to comprise an upper horizontally disposed insulation displacement contact member 158 and a lower horizontally disposed insulation displacement contact member 160 vertically spaced beneath the upper horizontally disposed insulation displacement contact member 158. The upper insulation displacement contact member 158 is substantially planar and is provided with a substantially central slot 162 extending longitudinally inwardly from a front edge portion of the contact member 158, and the lower insulation displacement contact member 160 is also substantially planar and is likewise provided with a substantially central slot 164 extending longitudinally inwardly from a front edge portion of the contact member 160. The slots 162,164 permit the insertion therewithin of electrical wires, not shown, whose insulation is to be stripped or displaced by means of the side walls of the contact portions 158,160 which define the slots 162,164 so as to establish electrical contact in a well-known manner. The contact members 158,160 are integrally connected together by means of an upstanding side wall 166 such that the insulation displacement portion of each one of the electrical contacts 156, comprising the contact members 158,160 and side wall 166, has a substantially C-shaped configuration as seen in cross-section.

The rear edge portion of each one of the contact members 158,160 is respectively provided with an integral, substantially upstanding pin-engaging contact member 168, 170 whereby the composite contact members 158,168 and 160, 170 have substantially L-shaped configurations as considered in cross-section. The longitudinal extent or length of the lower contact member 160 is greater than that of the upper contact member 158, and accordingly, pin-engaging contact member 170 is disposed rearwardly of the pin-engaging contact member 168 such that a space or gap is defined between each one of the pin-engaging contact members 168,170 so as to respectively accommodate one of the pin contact portions 116 of the electrical contacts 114. It is also appreciated that the pin-engaging contact member 168 is inclined rearwardly, while the pin-engaging contact member 170 is inclined forwardly, as may best be appreciated from FIG. 3, and the upper distal end portion of each one of the contact members 168,170 is provided with a dimpled portion 172,174. As a result of the electrical contacts 156 being formed from metal stampings, the aforenoted oppositely oriented inclinations of the contact members 168,170 render the contact members 168,170 inherently resilient when they are slidably engaged with the pin contact portions 116 of the electrical contacts 114 such that good electrical contact is generated between the dimpled portions 172,174 of the contact members 168,170 and the pin contact portions 116 when the electrical connector 150 of the present invention is mounted upon the card edge connector 112 such that the pin contact portions 116 extend upwardly through the electrical connector 150 as best appreciated from FIG. 3.

Figure 7:
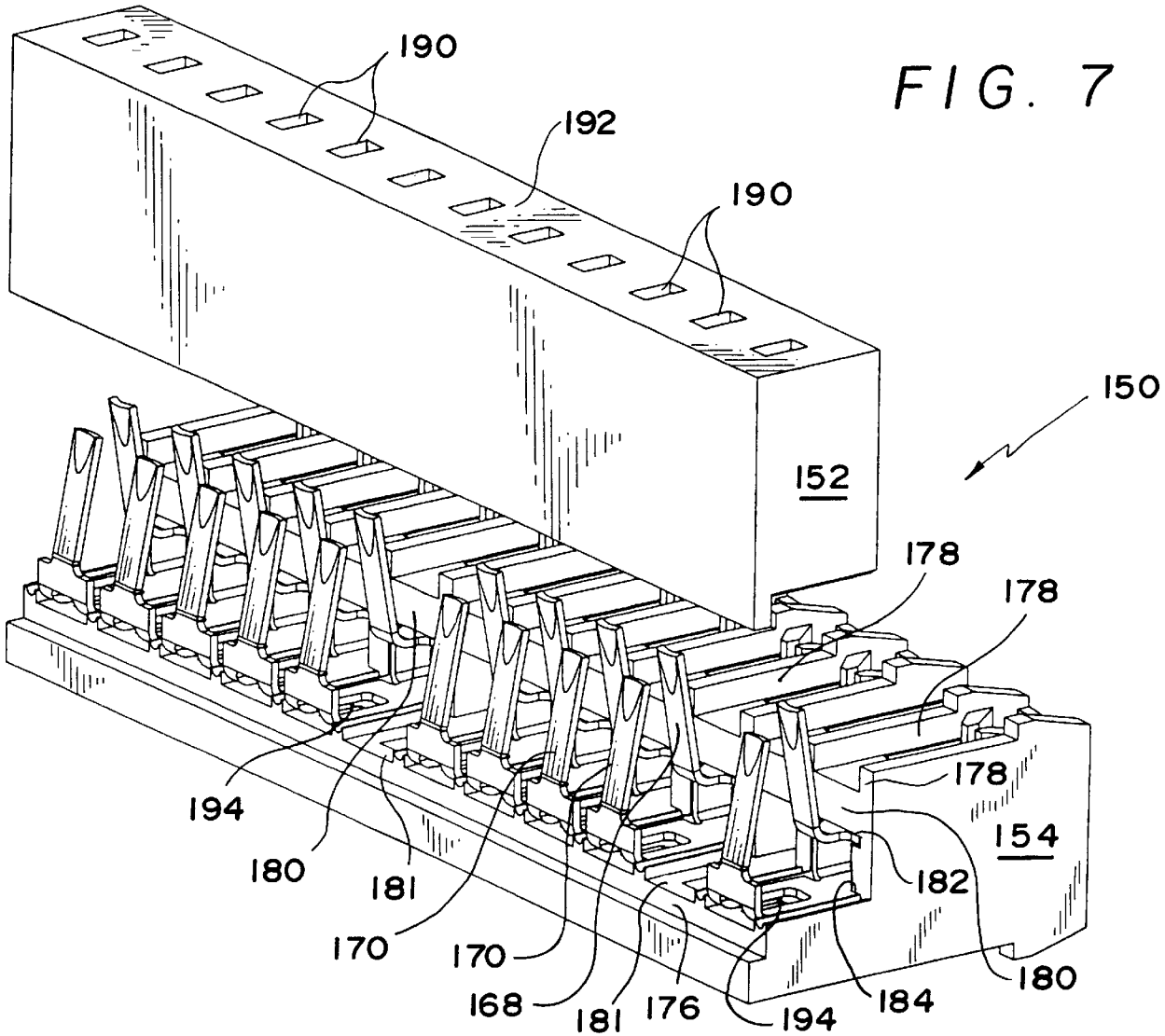
FIG. 7 is a perspective view of the new and improved electrical connector constructed in accordance with the principles and teachings of the present invention and as disclosed within FIG. 6 but showing, however, the connector in a partially disassembled exploded condition.
Figure 8:
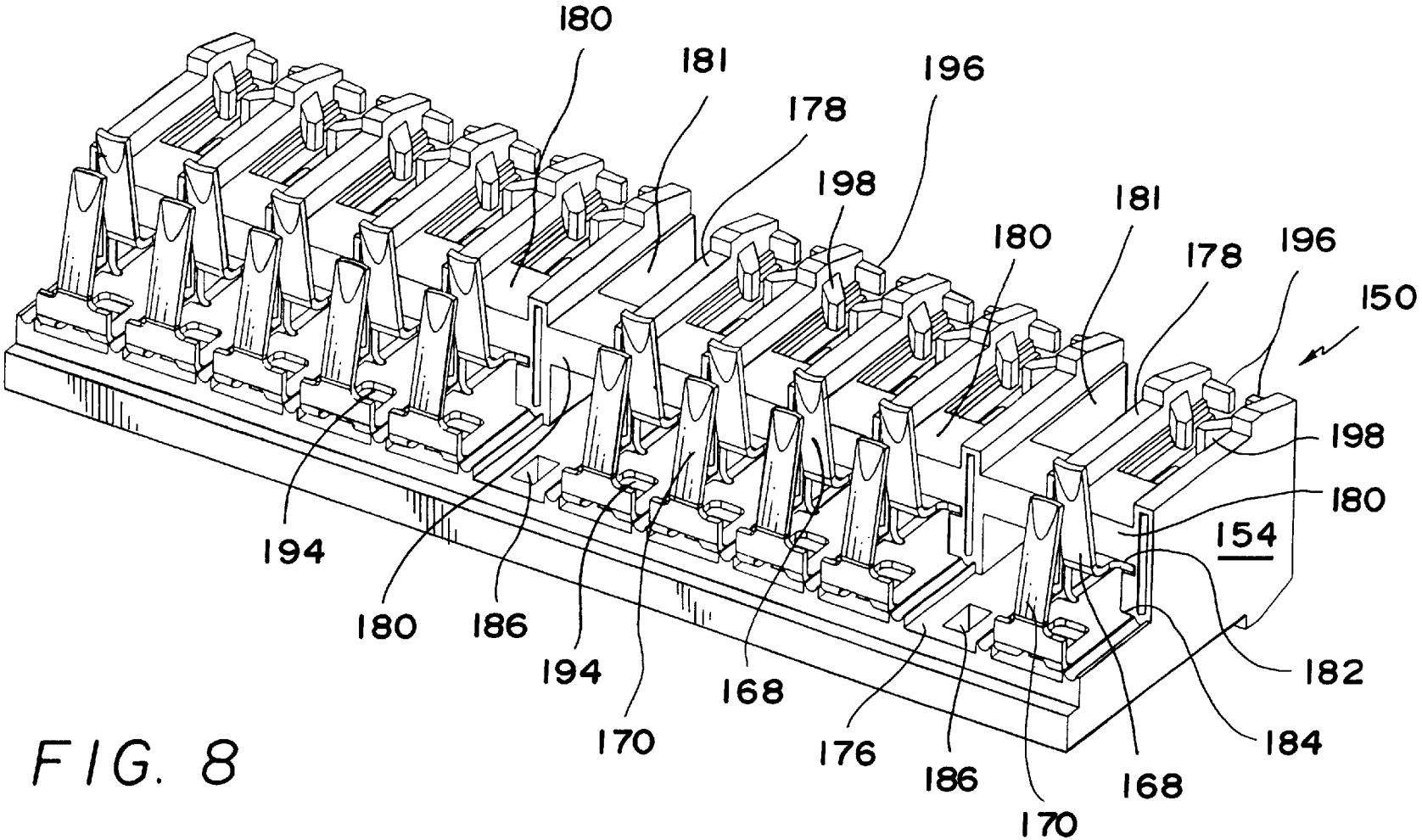
FIG. 8 is a perspective view of the new and improved electrical connector constructed in accordance with the principles and teachings of the present invention and as disclosed within FIGS. 6 and 7 showing, however, only the bottom or lower section of the connector with the insulation displacement-pin engaging contacts disposed therein.

With reference now being made to FIGS. 7 and 8, it is seen that the lower housing portion 154 of the electrical connector 150 comprises an elongated block which comprises a floor portion 176, a plurality of laterally spaced, upstanding side walls 178, and a plurality of laterally or transversely disposed cross-beams 180 integrally interconnecting upper end portions of the side walls 178 such that a plurality of electrical contact sockets 181 for housing the electrical contacts 156 are defined within the lower housing portion 154 of the connector 150. Upper and lower vertically spaced channels 182,184 are defined within interior wall surface portions of each right side wall 178 respectively associated with each one of the electrical contact sockets 181 of the lower housing portion 154 for respectively receiving a right edge portion of each one of the contact members 158,160. At the same time, the upstanding side wall 166 of each electrical contact 156 is disposed in abutting contact with an interior wall surface portion of each left side wall 178 respectively associated with each one of the electrical contact sockets 181 of the lower housing portion 154, and the lower contact member 160 is seated upon a region of the floor portion 176 of the housing 154 respectively associated with each one of the electrical contact sockets 181, whereby the electrical contacts 156 are respectively fixedly mounted within the lower housing portion 154 of the connector 150.

The floor region of each one of the electrical contact sockets 181 defined within the lower housing portion 154 is provided with a through-aperture 186, and as best seen in FIG. 3, the interior of upper housing portion 152 is provided with a plurality of hollow or recessed regions 188 for respectively accommodating each pair of upstanding pin-engaging contact members 168,170. The hollow recessed regions 188 terminate with apertures 190 which are defined within the upper surface 192 of the upper housing portion 152. In a similar manner, each one of the rearward portions of the lower contact member 160 of each electrical contact 156 is provided with a through-aperture 194. In this manner, each respective set of lower housing portion apertures 186, contact apertures 194, upper housing recess or hollow portions 188, and upper housing portion apertures 190 are axially aligned with respect to each other such that card edge connector contact pins 114 can pass therethrough as can best be appreciated from FIG. 3.

It is lastly seen that in connection with the insertion of the external telephone signal lines or wires into the electrical connector 150, and particularly into the lower housing portion 154 so as to be inserted into the slotted portions 162,164 defined upon the contact members 158,160 such that the wire insulation can be displaced or stripped so as to establish electrical connection with the contact members 158,160, forward end portions of each interior surface of each one of the side walls 178 of the lower housing portion 154, which are operatively connected or lead into each one of the contact sockets 181, is provided with a perpendicular tab member 196. In this manner, oppositely disposed tab members 196,196 of adjacent side walls 178,178 define an opening for permitting insertion of the wires into the contact sockets 181. In addition, an angled tab member 198 is similarly provided upon each interior surface of each one of the side walls 178 at a position downstream from tab members 196, as considered in the wire insertion direction, so as to laterally guide the inserted wire toward its centralized position with respect to insulation displacement slotted regions 162,164 of the contact members 158,160. When the electrical wires are to be inserted into the insulation displacement contact members 158,160, the wires are initially inserted between the oppositely disposed tab members 196, 196 leading into each one of the contact sockets 181 whereby the wires will in effect be retained at a position between the perpendicular tab members 196,196 and the angled tab members 198,198 in readiness for insertion of the wires into the slotted portions 162,164 of the contact members 158,160. Subsequently, the wires can then be moved between the angled tab members 198,198 and into the slotted portions 162,164 of the contact members 158,160 whereby insulation displacement electrical connection between the wires and the contact members 158,160 is established. It is to be noted that in accordance with a particular or predetermined application or use of the electrical connector 150 of the present invention, different sized wires, similar to the wires 22 illustrated in FIGS. 1 and 2, can be accommodated within the electrical connector 150. It is also particularly noted from FIGS. 7 and 8 that while the electrical connector 150 is provided with, for example, twelve electrical connector sockets 181 disposed in a side-by-side array with respect to each other, depending upon a particular or predetermined application or use of the electrical connector 150 of the present invention, electrical contacts may only be provided within predetermined ones of the sockets 181. In the illustrated example, it is seen that electrical contacts 156 are not provided at the second and seventh socket locations.

When an electrical assembly such as that shown, for example, in FIG. 3 at 110 is to be assembled, the electrical connector 150 of the present invention is mounted atop the card edge connector 112 such that the upstanding pin contacts 116 of the card edge connector 112 pass upwardly through the electrical connector 150. More specifically, the upstanding pin contacts 116 of the card edge connector 112 will respectively pass upwardly through the apertures 186 formed within the floor portion 176 of the lower connector housing portion 154, through the apertures 194 formed within the contact members 160, in slidable friction contact between the sets of contact members 168,170, and outwardly through the apertures 190 formed within the upper portion 192 of the upper connector housing portion 152. In addition, telephone signal lines or wires, similar to wires 22 illustrated in FIGS. 1 and 2, can be inserted in accordance with insulation displacement techniques through the forward portions of the lower connector housing portion 154 so as to be inserted into the slotted regions 162,164 of the electrical contact members 158,160. Lastly, the over-protection printed circuit board 126, which may be of the gas-tube type over-protection printed circuit board having the gas tube over-protection devices 128 mounted thereon, can be mounted upon the upper distal ends of the upstanding pin contacts 116. The printed circuit board 126 is provided with a plurality of apertures 200 for permitting the upper distal ends of the upstanding pin contacts 116 to pass therethrough, and contact caps or sockets 202 are fixedly mounted upon the printed circuit board 126 so as to electrically engage the upper distal ends of the upstanding pin contacts 116 in a snap or friction-fit manner. It is noted that other types of over-protection printed circuit boards may of course be employed in accordance with the principles and teachings of the present invention.

Alternatively, the electrical assembly 110 shown in FIG. 3 may be assembled in a manner which is, in effect, reverse or alternative to the aforenoted assembly procedure. For example, in lieu of the electrical connector 150 being initially mounted upon the upstanding pin contacts 116 of the card edge connector 112, and the telephone signal wires subsequently engaged with the contact members 158,160, the telephone signal wires may be initially engaged with the contact members 158,160 and subsequently, the electrical connector 150 and the telephone signal wires or lines can then be mounted as an entity structure or wire harness upon the card edge connector 112.

Figure 9:
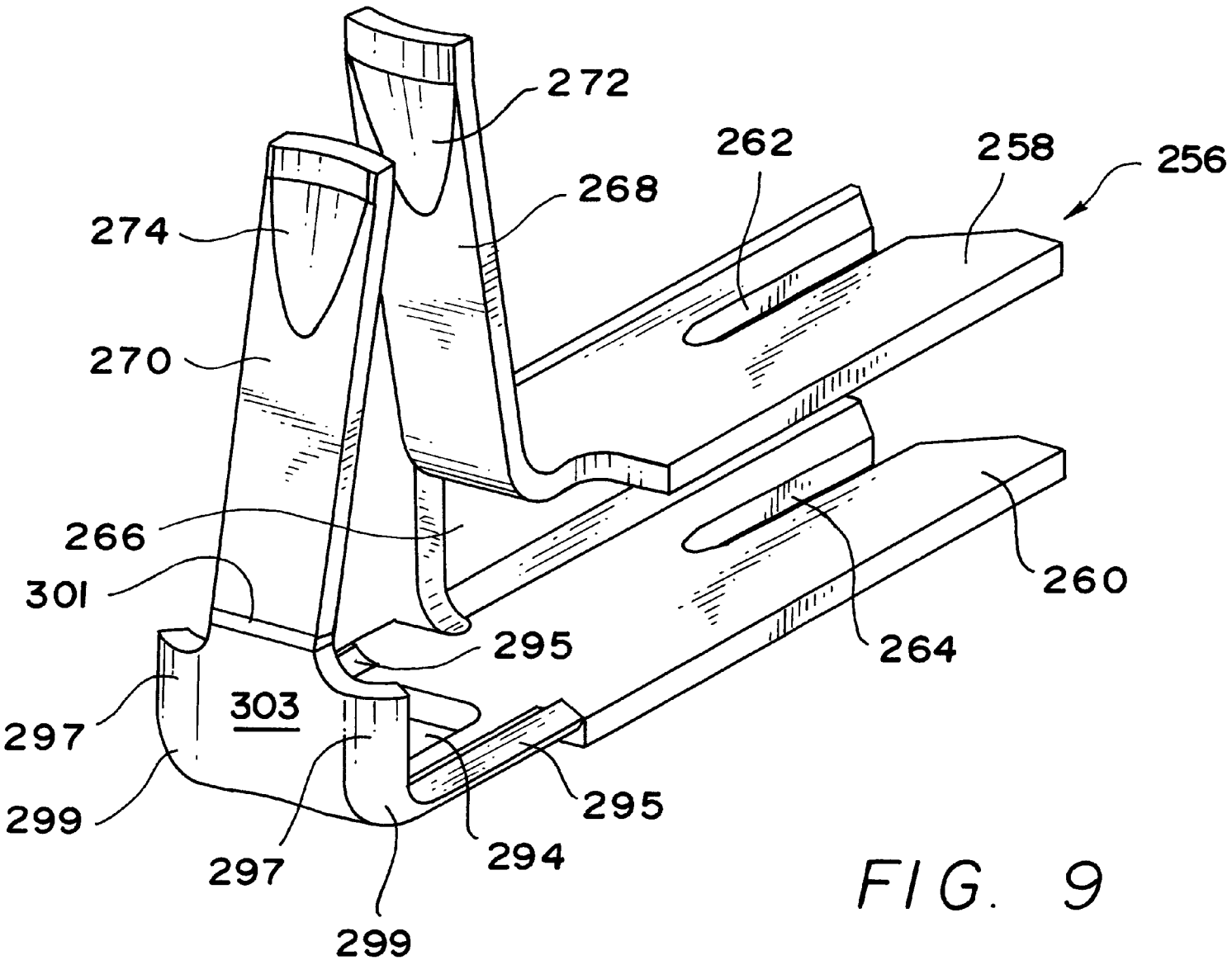
FIG. 9 is a perspective view similar to that of FIG. 5 showing, however, a second embodiment of an insulation displacement-pin engaging contact which can be utilized within the new and improved electrical connector constructed in accordance with the principles and teachings of the present invention.
Figure 10:
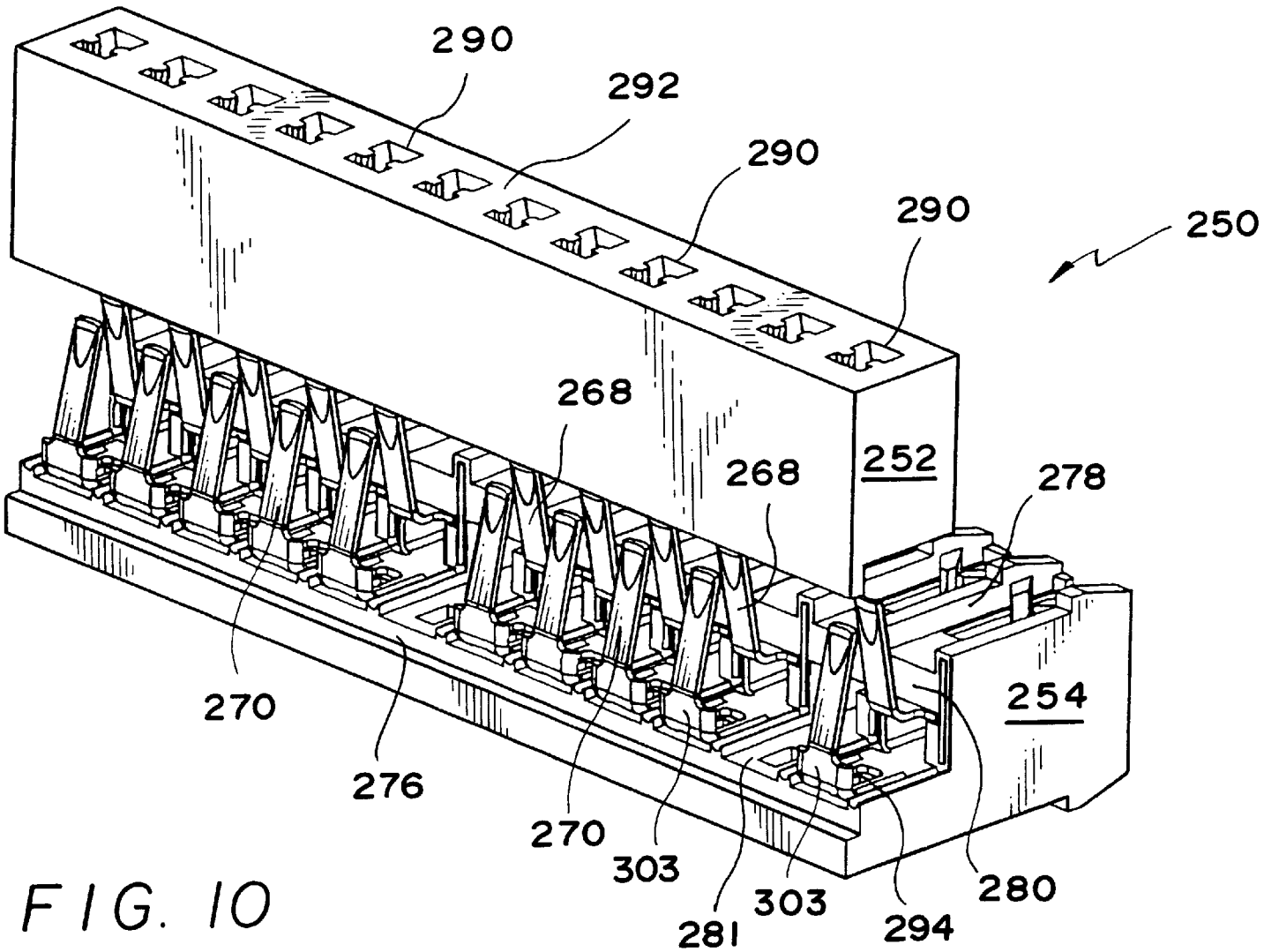
FIG. 10 is a perspective view similar to that of FIG. 7 showing, however, a second embodiment of a new and improved electrical connector constructed in accordance with the principles and teachings of the present invention and having the second embodiment electrical connector contacts, as disclosed within FIG. 9, incorporated therein.

With reference now being made to FIGS. 9 and 10, a second embodiment of an electrical contact, which may be utilized within a second embodiment of an electrical connector constructed in accordance with the principles and teachings of the present invention, is disclosed and generally indicated by reference character 256, while the second embodiment of the electrical connector is designated by reference character 250. It is noted, in the interest of brevity, that a detailed description of the electrical contact 256 and the electrical connector 250 will not be described in view of the fact that electrical contact 256 is substantially identical to the electrical contact 156, except as will be noted hereinafter, and similarly for the electrical connector 250 with respect to the electrical connector 150. Accordingly, while not being actually described, primary components of the electrical contact 256 will be designated by reference characters which correspond to the reference characters of the corresponding components of the electrical contact 156 except that the components of the electrical contact 256 will be within the 200 and 300 series, and similarly for the reference characters designating the various components of the electrical connector 250.

More particularly, then, it is seen that the major difference between the electrical contact 256 and the electrical contact 156 resides in the fact that the electrical contact 256 comprises or incorporates therein, in effect, reinforcing horizontally disposed side rail or ribbed members 295,295, vertically disposed rail or ribbed members 297,297, and curved corner rail or ribbed members 299,299 which effectively interconnect the side rail or ribbed members 295,295 to the vertical rail or ribbed members 297,297, respectively. With the electrical contact 156 as shown in FIG. 5, the vertically disposed pin-engaging contact member 170 is connected to the horizontally disposed insulation-displacement contact member 160 by means of laterally spaced, flexible leaf spring portions 193, and accordingly, the vertically disposed pin-engaging contact member 170 is able to experience substantial flexibility or transverse movement with respect to the horizontally disposed insulation-displacement contact member 160.

Alternatively, however, if it is desired to minimize or somewhat decrease the aforenoted flexibility of the vertical pin-engaging contact member 170 with respect to the horizontal insulation-displacement contact member 160, the reinforcing rail or ribbed members 295,299, and 297 effectively eliminate the aforenoted leaf spring portions whereby the flexible movements of the vertical pin-engaging contact member 270 are effectively prevented from being transmitted to the horizontal insulation-displacement contact member 260. In particular, the locus of the pivotal or flexible movements of the vertical pin-engaging contact member 270 with respect to the horizontal insulation-displacement contact member 260 is now defined at the interface 301 connecting the vertical pin-engaging contact member 270 to a vertical base portion 303 of the electrical contact 256. This differs from the electrical contact 156 wherein the locus of the pivotal or flexible movements of the vertical pin-engaging contact member 170 with respect to the horizontal insulation-displacement contact member 160 is defined at the locations or points at which the leaf spring portions 193 connect to the horizontal insulation-displacement contact member 160.

As disclosed within FIG. 10, the plurality of electrical contacts 256 are shown disposed within the electrical connector 250, and it is seen that the only significant difference between the electrical connector 250 as compared to the electrical connector 150 resides in the apertures 290 defined within the upper surface 292 of the upper electrical connector housing portion 252. More particularly, the apertures 290 are seen to have substantially H-shaped cross-sectional configurations which in effect define, in effect, individual compartments for each one of the vertically disposed pin-engaging contact members 268,270.

Thus, it may be seen that in accordance with the principles and teachings of the present invention, all of the various electrical connections between the card edge connector, the electrical connector of the present invention, and the printed circuit board are achieved in a slidable contact, solderless manner. More particularly, the pin contacts of the card edge connector engage the contact members of the electrical connector in a slidable friction-grip manner, the incoming power wires engage the contact members of the electrical connector by means of insulation displacement techniques, and the gas tube over-voltage printed circuit board electrically engages the pin contacts of the card edge connector through means of friction or snap fit means. Accordingly, all connections can be easily and rapidly made, and components of the entire assembly can be replaced or exchanged in a relatively minimal amount of time due to the elimination of conventional soldered and wire-wrapped connections.

Obviously, many variations and modifications of the present invention are possible in light of the above teachings. It is therefore to be understood that within the scope of the appended claims, the present invention may be practiced otherwise than as specifically described herein.

What is claimed is:

1. An electrical connector for electrically connecting external wiring to pin contacts of a second electrical connector, comprising:

an electrical connector housing; and a plurality of electrical connector contacts disposed within said electrical connector housing, wherein each one of said electrical connector contacts comprises first and second insulation-displacement contact members respectively having slots which are defined within first end portions of said first and second insulation-displacement contact members and which are disposed within a plane for enabling insulation-displacement electrical connection to an external wire to be oriented in a predetermined direction within said electrical connector housing, and first and second pin-engaging contact members respectively formed upon second opposite end portions of said first and second insulation-displacement contact members for defining together a slot, also oriented in said predetermined direction, within said electrical connector housing for receiving, in a slidable electrical connection manner, a pin contact of the second electrical connector which will therefore be disposed substantially paralled to the insulation-displacement connected external wire, whereby all electrical connections between the external wire and the pin contact are able to be solderless.

2. The electrical connector as set forth in claim 1, wherein:

said first and second insulation-displacement contact members are disposed substantially parallel to each other within horizontally disposed, vertically separated planes; and said first and second pin-engaging contact members are disposed substantially parallel to each other within vertically disposed, horizontally separated planes so as to define a space therebetween within which the pin contact of the second electrical connector can be disposed.

3. The electrical connector as set forth in claim 2, wherein:

both of said insulation-displacement contact members are integrally connected to each other by means of an upstanding side wall such that said insulation-displacement contact members together have a substantially C-shaped cross-sectional configuration.

4. The electrical connector as set forth in claim 2, wherein:

each one of said first and second insulation-displacement contact members is integrally connected to one of said first and second pin-engaging contact members such that together said each one of said first and second insulation-displacement contact members and said one of said first and second pin-engaging contact members integrally connected thereto comprises an electrical contact member having a substantially L-shaped cross-sectional configuration.

5. The electrical connector as set forth in claim 4, wherein:

a first one of said first and second insulation-displacement contact members has a greater longitudinal extent than a second one of said first and second insulation-displacement contact members so as to laterally space said first and second pin-engaging contact members from each other.

6. The electrical connector as set forth in claim 5, wherein:

said first one of said first and second insulation-displacement contact members is integrally connected to a first one of said first and second pin-engaging contact members by means of reinforcing rib members so as to effectively limit the flexible movements of said first one of said first and second pin-engaging contact members with respect to said first one of said first and second insulation-displacement contact members.

7. The electrical connector as set forth in claim 2, wherein:

said electrical connector housing comprises a plurality of sockets wherein each one of said plurality of sockets respectively houses one of said electrical connector contacts.

8. The electrical connector as set forth in claim 7, wherein:

each one of said sockets comprises a pair of channels for accommodating edge portions of each one of said first and second insulation-displacement contact members whereby said electrical connector contacts are securely mounted within said electrical connector housing.

9. The electrical connector as set forth in claim 7, wherein:

each one of said sockets of said electrical connector housing has a first aperture defined within a floor portion thereof; and each one of said electrical connector contacts has a second aperture defined therein for alignment with said first aperture defined within a respective one of said floor portions of said sockets defined within said electrical connector housing so as to permit pin contacts of the second electrical connector to be disposed through said first and second apertures.

10. An electrical connector for electrically connecting external wiring to pin contacts of a second electrical connector, comprising:

an electrical connector housing; and a plurality of electrical connector contacts disposed within said electrical connector housing, wherein each one of said electrical connector contacts comprises first and second insulation-displacement contact members formed at first end portions of said each one of said electrical connector contacts for enabling insulation-displacement electrical connection to an external wire, and first and second pin-engaging contact members respectively formed upon second opposite end portions of said each one said electrical connector contacts for slidable electrical connection with a pin contact of the second electrical connector, wherein said first one of said first and second insulation-displacement contact members has a greater longitudinal extent than said second one of said first and second insulation-displacement contact members so as to longitudinally space said first and second pin-engaging contact members from each other, whereby all electrical connections between the external wire and the pin contact are able to be solderless.

11. The electrical connector as set forth in claim 10, wherein:

said electrical connector housing comprises a plurality of sockets for respectively housing one of said plurality of electrical connector contacts;

each one of said plurality of sockets defined within said electrical connector housing has a first aperture defined within a floor portion thereof; and each one of said plurality of electrical connector contacts has a second aperture defined therein for alignment with said first aperture defined within a respective one of said floor portions of said sockets defined within said electrical connector housing so as to permit pin contacts of the second electrical connector to be disposed through said first and second apertures.

12. The electrical connector as set forth in claim 10, wherein:

said first and second insulation-displacement contact members are disposed substantially parallel to each other within horizontally disposed, vertically separated planes; and said first and second pin-engaging contact members are disposed substantially parallel to each other within vertically disposed, horizontally separated planes so as to define a space therebetween within which the pin contact of the second electrical connector can be disposed.

13. The electrical connector as set forth in claim 12, wherein:

each one of said first and second insulation-displacement contact members is integrally connected to one of said first and second pin-engaging contact members such that together said each one of said first and second insulation-displacement contact members and said one of said first and second pin-engaging contact members integrally connected thereto comprises an electrical contact member having a substantially L-shaped cross-sectional configuration.

14. The electrical connector as set forth in claim 12, wherein:

both of said first and second insulation-displacement contact members are integrally connected to each other by means of an upstanding side wall such that said insulation-displacement contact members together have a substantially C-shaped cross-sectional configuration.

15. An electrical connector contact for use within a first electrical connector for electrically connecting external wiring to pin contacts of a second electrical connector, comprising:

first and second insulation-displacement contact members respectively having slots which are defined within first end portions of said first and second insulation-displacement contact members and which are disposed within a plane for enabling insulation-displacement electrical connection to an external wire to be oriented in a predetermined direction within the first electrical connector, and first and second pin-engaging contact members respectively formed upon second opposite end portions of said first and second insulation-displacement contact members for defining together a slot, also oriented in said predetermined direction within the first electrical connector, for receiving, in a slidable electrical connection manner, a pin contact of the second electrical connector which will therefore be disposed substantially parallel to the insulation-displacement connected external wire, whereby all electrical connections between the external wire and the pin contact are able to be solderless.

16. The electrical connector contact as set forth in claim 15, wherein:

said first and second insulation-displacement contact members are disposed substantially parallel to each other within horizontally disposed, vertically separated planes; and said first and second pin-engaging contact members are disposed substantially parallel to each other within vertically disposed, horizontally separated planes so as to define a space therebetween within which the pin contact of the second electrical connector can be disposed.

17. The electrical connector contact as set forth in claim 15, wherein:

each one of said first and second insulation-displacement contact members is integrally connected to one of said first and second pin-engaging con-tact members such that together said each one of said first and second insulation-displacement contact members and said one of said first and second pin-engaging contact members integrally connected thereto comprises an electrical contact member having a substantially L-shaped cross-sectional configuration.

18. The electrical connector contact as set forth in claim 15, wherein:

both of said insulation-displacement contact members are integrally connected to each other by means of an upstanding side wall such that said insulation-displacement contact members together have a substantially C-shaped cross-sectional configuration.

19. The electrical connector contact as set forth in claim 15, wherein:

said electrical connector contact has an aperture defined therein so as to permit a pin contact of the second electrical connector to be inserted therethrough.

20. The electrical connector contact as set forth in claim 15, wherein:

a first one of said first and second insulation-displacement contact members has a greater longitudinal extent than a second one of said first and second insulation-displacement contact members so as to laterally space said first and second pin-engaging contact members from each other.

21. The electrical connector contact as set forth in claim 20, wherein:

said first one of said first and second insulation-displacement contact members is integrally connected to a first one of said first and second pin-engaging contact members by means of reinforcing rib members so as to effectively limit the flexible movements of said first one of said first and second pin-engaging contact members with respect to said first one of said first and second insulation-displacement contact members.

22. An electrical connector contact for use within a first electrical connector for electrically connecting external wiring to pin contacts of a second electrical connector, comprising:

first and second insulation-displacement contact members formed at first end portions of said electrical connector contact for enabling insulation-displacement electrical connection to an external wire, and first and second pin-engaging contact members respectively formed upon second opposite end portions of said electrical connector contact for slidable electrical connection with a pin contact of the second electrical connector, wherein said first one of said first and second insulation-displacement contact members has a greater longitudinal extent than said second one of said first and second insulation-displacement contact members so as to longitudinally space said first and second pin-engaging contact members from each other, whereby all electrical connections between the external wire and the pin contact are able to be solderless.

23. The electrical connector contact as set forth in claim 22, wherein:

said first and second insulation-displacement contact members are disposed substantially parallel to each other within horizontally disposed, vertically separated planes; and said first and second pin-engaging contact members are disposed substantially parallel to each other within vertically disposed, horizontally separated planes so as to define a space therebetween within which the pin contact of the second electrical connector can be disposed.

24. The electrical connector contact as set forth in claim 22, wherein:

each one of said first and second insulation-displacement contact members is integrally connected to one of said first and second pin-engaging contact members such that together said each one of said first and second insulation-displacement contact members and said one of said first and second pin-engaging contact members integrally connected thereto comprises an electrical contact member having a substantially L-shaped cross-sectional configuration.

25. The electrical connector contact as set forth in claim 22, wherein:

both of said first and second insulation-displacement contact members are integrally connected to each other by means of an upstanding side wall such that said insulation-displacement contact members together have a substantially C-shaped cross-sectional configuration.

26. The electrical connector contact as set forth in claim 22, wherein:

said first one of said first and second insulation-displacement contact members has an aperture defined therein so as to permit the pin contact of the second electrical connector to be inserted therethrough and into a space defined between said first and second pin-engaging contact members.

27. In combination, an electrical connector assembly comprising:

a first electrical connector comprising a housing having a plurality of first electrical pin contacts disposed therein; and a second electrical connector comprising a housing having a plurality of second electrical connector contacts disposed therein;

wherein each one of said plurality of first electrical pin contacts comprises a first end portion disposed in a recessed manner within said first electrical connector housing for electrical connection to a card edge connector which is adapted to be inserted into said first electrical connector housing, and a second end portion disposed externally of said first electrical connector housing; and wherein each one of said plurality of second electrical connector contacts comprises first and second insulation-displacement contact members respectively having slots which are defined within first end portions of said first and second insulation-displacement contact members and which are disposed within a plane for enabling insulation-displacement electrical connection to an external wire to be oriented in a predetermined direction within said second electrical connector housing, and first and second pin-engaging contact members respectively formed upon second opposite end portions of said first and second insulation-displacement contact members for defining together a slot, also oriented in said predetermined direction, within said second electrical connector housing for receiving, in a slidable electrical connection manner, one of said second end portions of said plurality of first electrical pin contacts disposed within said first electrical connector housing such that said one of said second end portions of said plurality of first electrical pin contacts is disposed within said second electrical connector housing in a substantially parallel manner with respect to the insulation-displacement connected external wire, whereby all electrical connections between the external wires and said first electrical pin contacts are able to be solderless.

28. The combination as set forth in claim 27, further comprising:

a gas tube over-protection printed circuit board;

a plurality of apertures defined within said gas tube over-protection printed circuit board for respectively permitting said second end portions of said first electrical connector pin contacts to pass therethrough; and a plurality of electrical contact caps disposed upon said printed circuit board and frictionally engaged with said second end portions of said first electrical connector pin contacts, whereby the electrical connections defined between the external wires and the second electrical connector contacts, between said second electrical connector contacts and said first electrical connector pin contacts, and between said first electrical connector pin contacts and said printed circuit board are solderless.

29. The combination as set forth in claim 27, wherein:

said first and second insulation-displacement contact members are disposed substantially parallel to each other within horizontally disposed, vertically separated planes; and said first and second pin-engaging contact members are disposed substantially parallel to each other within vertically disposed, horizontally separated planes so as to define a space therebetween within which a respective one of said first electrical pin contacts of said first electrical connector can be disposed.

30. The combination as set forth in claim 29, wherein:

both of said insulation-displacement contact members are integrally connected to each other by means of an upstanding side wall such that said insulation-displacement contact members together have a substantially C-shaped cross-sectional configuration.

31. The combination as set forth in claim 29, wherein:

each one of said first and second insulation-displacement contact members is integrally connected to one of said first and second pin-engaging contact members such that together said each one of said first and second insulation-displacement contact members and said one of said first and second pin-engaging contact members integrally connected thereto comprises an electrical contact member having a substantially L-shaped cross-sectional configuration.

32. The combination as set forth in claim 31, wherein:

a first one of said first and second insulation-displacement contact members has a greater longitudinal extent than a second one of said first and second insulation-displacement contact members so as to laterally space said first and second pin-engaging contact members from each other.

33. The combination as set forth in claim 32, wherein:

said first one of said first and second insulation-displacement contact members is integrally connected to a first one of said first and second pin-engaging contact members by means of reinforcing rib members so as to effectively limit the flexible movements of said first one of said first and second pin-engaging contact members with respect to said first one of said first and second insulation-displacement contact members.

34. The combination as set forth in claim 31, wherein:

said second electrical connector housing comprises a plurality of sockets wherein each one of said plurality of sockets respectively houses one of said second electrical connector contacts.

35. The combination as set forth in claim 34, wherein:

each one of said sockets comprises a pair of channels for accommodating edge portions of each one of said first and second insulation-displacement contact members whereby said second electrical connector contacts are securely mounted within said second electrical connector housing.

36. The combination as set forth in claim 34, wherein:

each one of said sockets of said second electrical connector housing has a first aperture defined within a floor portion thereof; and each one of said second electrical connector contacts has a second aperture defined therein for alignment with said first aperture defined within a respective one of said floor portions of said sockets defined within said second electrical connector housing so as to permit said pin contacts of said first electrical connector to be disposed through said first and second apertures.

37. In combination, an electrical connector assembly comprising:

a first electrical connector comprising a housing having a plurality of first electrical pin contacts disposed therein; and a second electrical connector comprising a housing having a plurality of second electrical connector contacts disposed therein;

wherein each one of said plurality of first electrical pin contacts comprises a first end portion disposed in a recessed manner within said first electrical connector housing for electrical connection to a card edge connector which is adapted to be inserted into said first electrical connector housing, and a second end portion disposed externally of said first electrical connector housing; and wherein each one of said plurality of second electrical connector contacts comprises first and second insulation-displacement contact members formed at first end portions of said each one of said plurality of second electrical connector contacts for enabling insulation-displacement electrical connection to an external wire, and first and second pin-engaging contact members respectively formed upon second opposite end portions of said each one of said plurality of second electrical connector contacts for slidable electrical connection with one of said second end portions of said plurality of first electrical pin contacts disposed within said first electrical connector housing, wherein said first one of said first and second insulation-displacement contact members has a greater longitudinal extent than said second one of said first and second insulation-displacement contact members so as to longitudinally space said first and second pin-engaging contact members from each other, whereby all electrical connections between the external wires and said first electrical pin contacts are able to be solderless.

38. The combination as set forth in claim 37, wherein:

said second electrical connector housing comprises a plurality of sockets for respectively housing one of said plurality of electrical connector contacts;

each one of said plurality of sockets defined within said second electrical connector housing has a first aperture defined within a floor portion thereof; and each one of said plurality of electrical connector contacts has a second aperture defined therein for alignment with said first aperture defined within a respective one of said floor portions of said sockets defined within said second electrical connector housing so as to permit said pin contacts of said first electrical connector to be disposed through said first and second apertures.

39. The combination as set forth in claim 37, wherein:

said first and second insulation-displacement contact members are disposed substantially parallel to each other within horizontally disposed, vertically separated planes; and said first and second pin-engaging contact members are disposed substantially parallel to each other within vertically disposed, horizontally separated planes so as to define a space therebetween within which the pin contact of the second electrical connector can be disposed.

40. The combination as set forth in claim 39, wherein:

each one of said first and second insulation-displacement contact members is integrally connected to one of said first and second pin-engaging contact members such that together said each one of said first and second insulation-displacement contact members and said one of said first and second pin-engaging contact members integrally connected thereto comprises an electrical contact member having a substantially L-shaped cross-sectional configuration.

41. The combination as set forth in claim 39, wherein:

both of said first and second insulation-displacement contact members are integrally connected to each other by means of an upstanding side wall such that said insulation-displacement contact members together have a substantially C-shaped cross-sectional configuration.

* * * * *